United States Patent [19]
Viljanmaa
[11] 4,202,190
[45] May 13, 1980

[54] APPARATUS FOR HIDE STRETCHING

[76] Inventor: Antti K. Viljanmaa, 34800 Virrat, Finland

[21] Appl. No.: 939,977

[22] Filed: Sep. 6, 1978

[30] Foreign Application Priority Data

Sep. 6, 1977 [FI] Finland ..... 772643

[51] Int. Cl.² ..... C14B 1/26; D06C 3/08
[52] U.S. Cl. ..... 69/19.3; 38/102.91
[58] Field of Search ..... 69/19, 33, 34, 35, 19.1, 69/19.2, 19.3; 38/102.1, 102.91

[56] References Cited

U.S. PATENT DOCUMENTS

| | | | |
|---|---|---|---|
| 1,911,556 | 5/1933 | Staebler | 69/19.3 |
| 3,391,635 | 7/1968 | Matheus | 69/19.3 |

FOREIGN PATENT DOCUMENTS

| | | | |
|---|---|---|---|
| 11619 | 11/1854 | France | 69/19.3 |
| 650965 | 2/1929 | France | 69/19.3 |

*Primary Examiner*—Patrick D. Lawson
*Attorney, Agent, or Firm*—Robert J. Schiller

[57] ABSTRACT

A hide stretching apparatus, in particular one for the tentering of hides for drying. The apparatus comprises a stretching frame with a number of mutually spaced radial sliding guides. The stretching clamps gripping the edges of the hide have been arranged to be reciprocatingly movable along the sliding guides. The stretching frame is placed upon a special hide changing table carrying under each sliding guide a clamp displacement member. The clamps carry jaws which attach to the edge of the hide to be stretched. The jaws are opened and closed by means of a lever turnably carried on the clamp. The clamp displacement member has two gripping members, which can be made to engage the clamp on both sides according to commands given, for the displacing of the clamps reciprocatingly along the sliding guides. The clamp comprises a brake engaging with the sliding guide and which with the jaws in closed position prevents the displacement of the clamp towards the center of the stretching frame. The lever turning the jaws into their opened and closed position pushes, when the jaws are opened, the brake against the force of a spring into a position such that the clamp is free to move in either direction, whereby the clamps can be moved into clamping position and into detachment position.

9 Claims, 5 Drawing Figures

APPARATUS FOR HIDE STRETCHING

The present invention concerns an apparatus for the stretching of hides, in particular for tentering hides to the purpose of their drying, such apparatus comprising a stretching frame and stretching clamps for attachment to the margin of the hide, these clamps arranged to be movable to and fro with the aid of clamp displacing members on the hide changing table, along radial sliding guides on the stretching frame, a brake which when the clamps are in closed position clamps onto the sliding guide, preventing any movements of the clamp towards the centre of the frame but permitting its movement towards the outer periphery, and a turnably carried lever engaging with the clamping jaws so as to turn them open or shut.

An apparatus of this kind is known in the art through the German application print No. 2,322,213. In this apparatus of prior art, the design of the clamp mechanism and the cooperation of the clamp with the clamp displacing member moving it are such that the operation of the apparatus is made unreliable. If the stop nose of the clamp displacement member releases the brake before the stopping, effected by the microswitch, of the clamp displacement member, the clamp means will move before the clamp displacement member through an indefinite distance in the hide stretching direction, until the force of the spring in the brake is overcome by the stop force caused by the hide or by another obstacle. In the other event the clamp displacement member will stop under effect of the microswitch, already before the brake of the clamp means has been set free for the return movement of the clamp. The movement of the clamp means is not beyond reproach during the stretching phase either, the operation of the brake implying that the clamp detached from the clamp displacement member has to move a short distance in the stretching direction before stopping. This results in the loss of part of the stretching force, and the forces pulling the hide taut in various directions will be indefinite and of different magnitudes.

The object of the invention is: to improve an apparatus of the type proclaimed, in such manner that the said drawbacks are avoided.

This aim is achieved by the apparatus of the invention on the strength of the characteristic features set forth in the attached claims.

In the following an embodiment example of the invention shall be more closely described, with reference being made to the attached drawings, wherein:

FIG. 1 displays the stretching frame of the invention, schematically and in top view, and FIG. 2 shows the section carried along the line II—II in FIG. 1.

Figure 1:
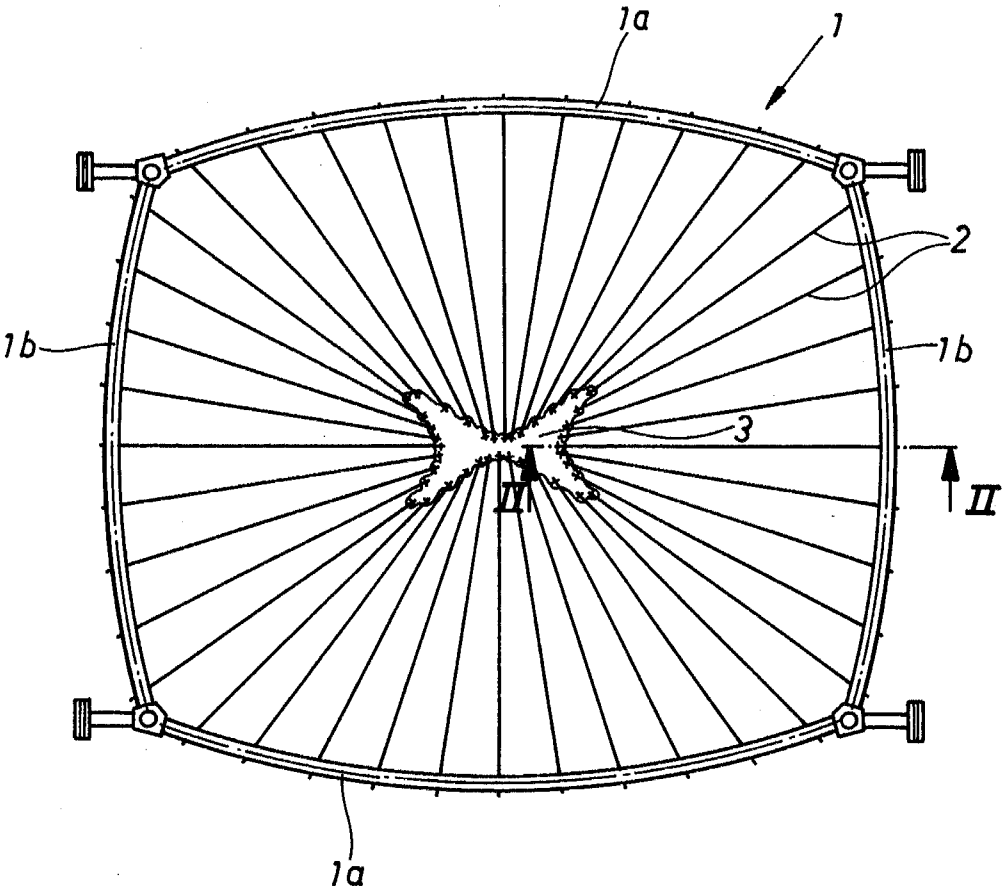

Referring now to FIG. 1, the stretching frame therein displayed is composed of four tubular components 1*a*, 1*b* having a rectangular cross section and which are joined by their ends to constitute a frame of substantially quadrangular configuration. Between the frame parts 1*a*, 1*b* and the centre piece 3, radially extending sliding guides

Figure 2:
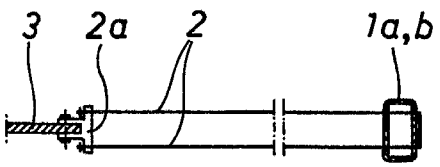

2 made of steel wire of a suitable gauge have been stretched tight, the hide stretching clamps moving along these guides in a manner to be described more closely later on. The sliding guides 2 have been affixed to the plate-shaped centre piece 3 by means of fixing pieces 2*a*, which are free to orient themselves in the direction of pull. The frame parts 1*a* and 1*b* are outwardly curved in order to take up the tension forces. The centre plate 3 has the shape appearing from FIG. 1 in order to make the sliding guides 2 substantially equal in length. As can be read from FIG. 2, the sliding guides have been formed so that the legs of the steel wire bent into U shape lie one above the other in the vertical plane.

Figure 3:
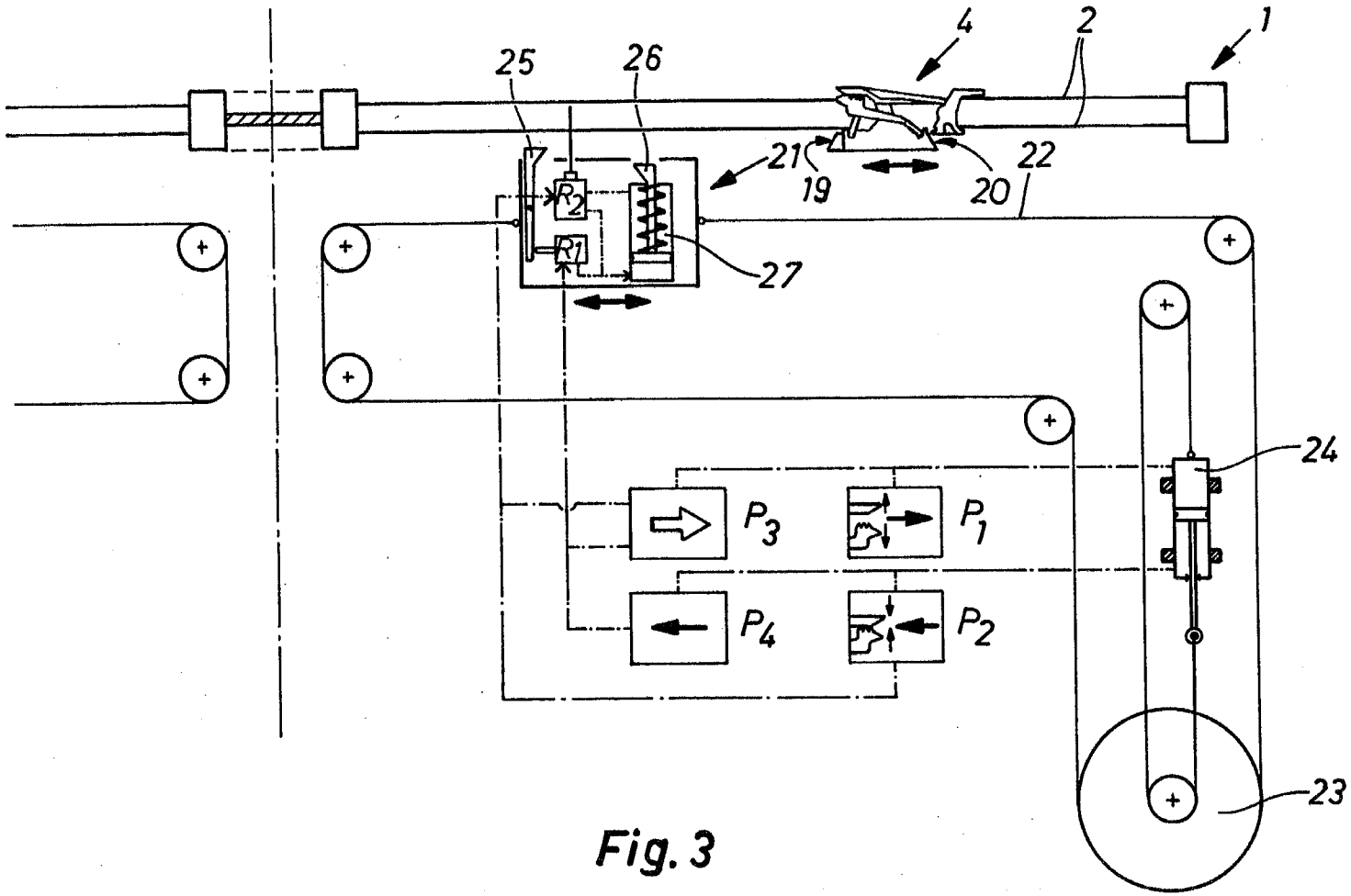
FIG. 3 illustrates, schematically, the construction and working principle of the apparatus of the invention.
Figure 4:
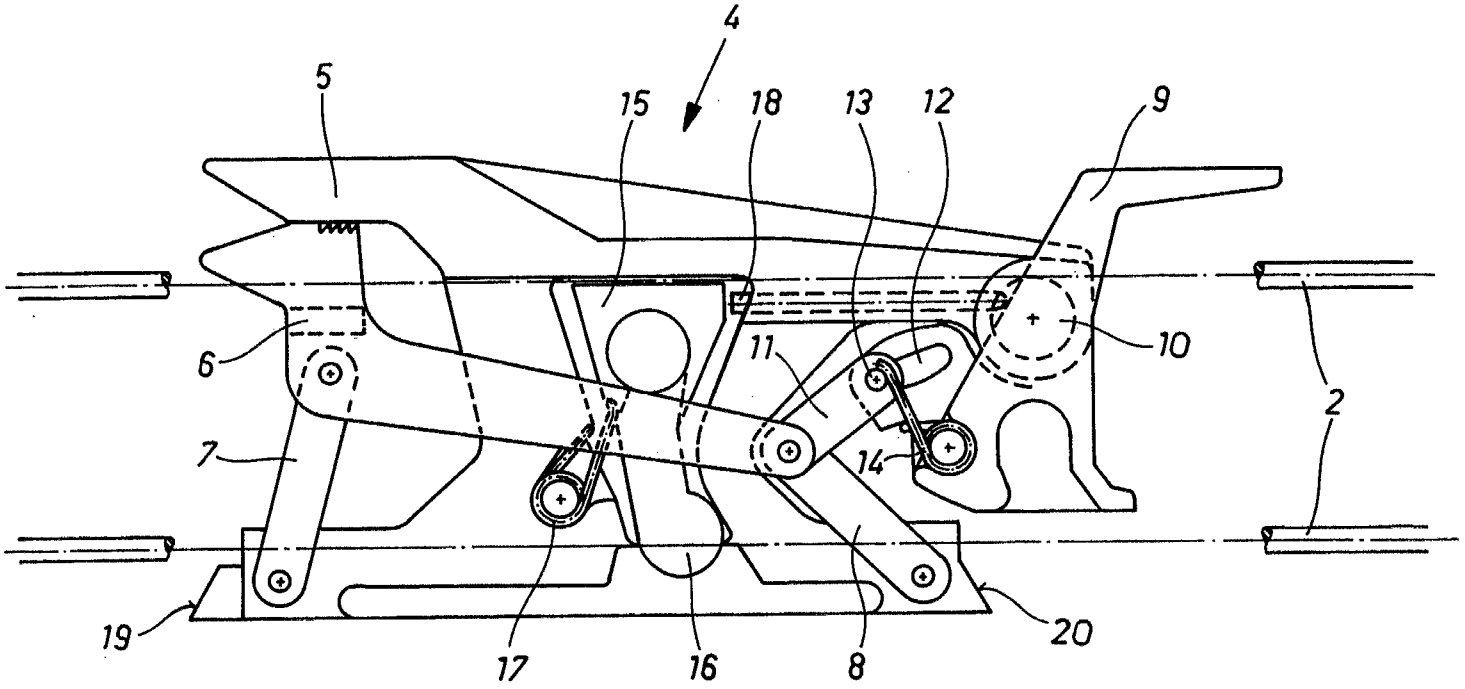
FIG. 4 shows the stretching clamp which is part of the apparatus of the invention, in elevational view and with the clamping jaws in the closed position.
Figure 5:
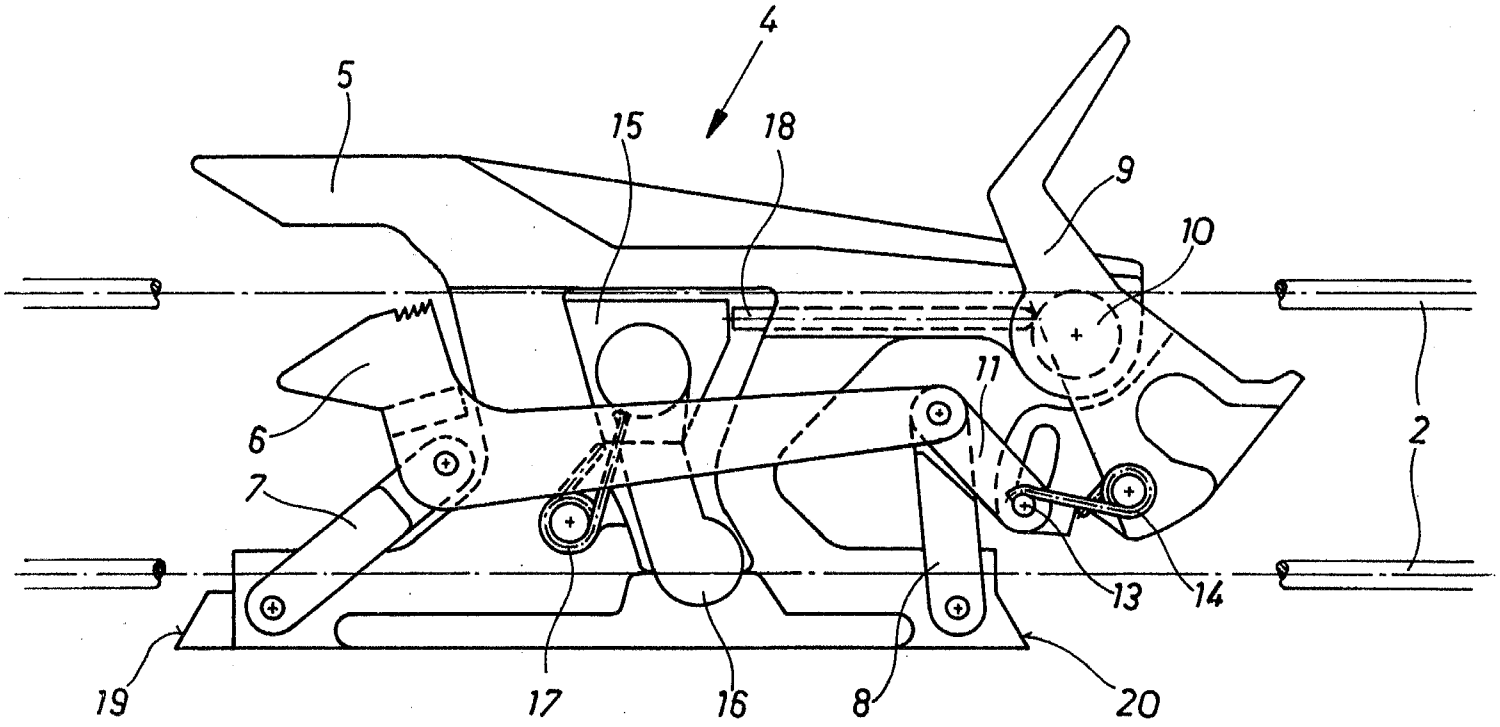
FIG. 5 shows the same as FIG. 4, though with the clamping jaws in the opened position.

To make the principle of operation presented in FIG. 3 more readily understandable, the design and operation of the stretching clamp 4 shall first be described in greater detail with the aid of FIGS. 4 and 5. The body of the clamp 4 is integral with the upper clamping jaw 5. The lower clamping jaw 6 is turnably carried in the body with the aid of two pivotal levers, 7 and 8, which constitute a four-pivot system. The positions of levers 7 and 8 have been chosen such that as the jaw 6 moves backwardly the jaws 5,6 will open, while at the same time the rear end of the movable lower jaw (in FIGS. 4 and 5, the right-hand end) will move upwardly. The lever 9 turnably carried on the axle 10, and which opens and closes the jaws, attaches to the rear end of said jaw 6 by means of a third pivotal link 11. The lever 9 has an elongated aperture 12, in which the pivot pin 13 is free to move against the force of a spring 14. This has the effect that hides of varying thickness may be impacted between the closed jaws 5 and 6. The lever 7 has a direction and position such that when the jaw 6 is subjected to pull in the stretching direction, that its towards the left in FIGS. 4 and 5, the jaw 6 will be urged with greater force against the jaw. However, the jaw 6 that has been urged shut is openable by a comparatively light turning motion of the lever 9 to revert to the position appearing in FIG. 5.

In order to ensure that the stretching clamp 4 is held in the stretching position on its sliding guide 2, the clamp has been provided with a brake piece 15, this piece being able to turn a minor amount about the axis 16. When in action, the brake piece 15 has turned, pushed by the spring 17, into the position shown in FIG. 4, in which its top surface rests against the upper sliding guide 2, whereby owing to the disposition of the turning axis 16 the clamp 4 is prevented from moving in the stretching direction, or from right to left, while it is permitted to move in the opposite direction. When the lever 9 is turned into the jaw-opening position of FIG. 5, the pin 18 pushes the brake 15, against the force of the spring 17, out of contact with the sliding guide 2, whereby the clamp 4 is enabled to move freely in either direction. Furthermore, the clamp 4 features abutment faces 19 and 20, with which the gripping members of the clamp displacement member may engage.

The above-described stretching clamp 4 rising on the guides 2 of the stretching frame 1 has been schematically illustrated in FIG. 3. The stretching frame 1 has been placed on the hide changing table, where a clamp displacement member 21 has been provided for each stretching clamp 4. This member is moved reciprocatingly by means of chains 22 carried over suitable sheaves and driven by the sprocket wheel 23, which is set in motion by a pneumatic piston-and-cylinder means 24. The clamp displacement member 21 comprises a first gripping member 25, which when it abuts on the boundary face 19 of the clamp 4 supplies over the limit switch/valve $R_1$ an actuating pulse to the pneumatic piston-and-cylinder means 27. Connected to the piston rod of the piston-and-cylinder means 27 is another gripping member 26, which upon being raised by the piston rod engages behind the abutment face 20 of the clamp 4. Moreover, there connects with the piston rod of the piston-and-cylinder means 27, a linkage mechanism, not depicted, by means of which the piston rod, as it rises, turns the lever 9 of the clamp into the open jaw position shown in FIG. 5. The displacement member 21 moreover comprises a high edge sensor $R_2$, moved along by the piston rod of the piston-and-cylinder means 27, up into operating position and back into the position at rest.

The operation of the apparatus proceeds by the following steps.

1. Detaching a dried hide from the frame

The stretching frame 1, on which an already dried hide is tentered, is lowered down on the hide changing table, on the top of which the clamp displacement members 21 are moving. On depression of the control push button $P_1$, the clamp displacement member 21 starts to move towards the outer periphery. When the gripping member 25 meets the abutment face 19 of the clamp 4, the limit switch/valve $R_1$ admits air into the cylinder 27, whereby its piston rises upwardly, lifting the second gripping member 26 into position behind the abutment face 20 and, at the same time, turning by means of the linkage mechanism not depicted, the lever 9 of the clamp into the open position. The jaws 5,6 of the clamp 4 open, and the displacement members 25 may continue their travel towards the outer periphery, together with the clamps 4. At the same time the hide edge sensor $R_2$ has also come up into its operating position, in which its feeler bristle extends to be above the plane of the hide. The displacement member 21 and the clamp 4 continue, together, up to the margin of the frame, where they encounter a mechanical limit. The cylinder 24 remains under pressure. Although the sensor $R_2$ has been raised at this step already, touching this sensor does not yet produce any action.

2. Clamping of a hide

After detaching the dried hide, as has been described, another hide is spread out upon the stretching frame 1, and the control button $P_2$ is depressed. The displacement member 21 will move the clamp 4 towards the centre. Depression of $P_2$ has also activated the sensor $R_2$, and on encountering an obstacle (the edge of the hide) the sensor will let the air out of the cylinder 27. The piston of the cylinder 27, when moving downwardly, closes by mediation of the linkage mechanism not depicted, the clamp 4 by turning the lever 9 into the position shown in FIG. 4. The downward movement of the piston of cylinder 27 also shifts the sensor $R_2$ to be below the operating plane (the top level of the upper sliding guide 2). The displacement member 21 will now stop and the clamp 4 will remain stationary, clamped to the edge of the hide.

3. Stretching the hide

Using the push button $P_3$, the displacement member is controlled to move towards the outer periphery of the stretching frame. Depression of $P_3$ also controls $R_1$ and $R_2$, which now become inactive. Now, when the gripping member 25 meets the abutment face 19 of the clamp 4, nothing happens other than pulling of the clamp 4 with the force of the cylinder 24. The stretching force may easily be arranged to be adjustable, even so that the changing table is divided into sectors, in each of which any desired magnitude of the stretching force may be selected, independent of the other sectors. It is hereby possible to stretch and distend the hide differently in different directions.

4. Returning the changing table into the initial position

The push button $P_4$ is used to return the displacement member 21 to the centre and to restore $R_1$ into active condition. The stretching frame 1 may now be taken off the table and transported to drying. Another stretching frame may be placed on the table, the dry hide detached from it and another hide tentered on it as has been described.

The apparatus may also be used to perform the softening elongation of the hide following after its drying, in which operation the leather fibres are detached from each other, which have become glued together in connection with drying.

I claim:

1. In a hide stretching apparatus, in particular for the tentering of wet hides for drying, of the type comprising in combination a stretching frame having peripherally attached thereto and radially extending inwardly therefrom a plurality of guides, each of said guides having a first end affixed to said frame and a second end affixed to a center piece located centrally in said frame;

a like plurality of clamps, individual ones of said clamps being slidably attached to corresponding ones of said guides so as to be movable in an inward direction and an outward direction, respectively toward said second end and said first end of a corresponding one of said guides, each of said clamps being provided with a pair of jaws operable, by a lever provided each clamp, between an open position and a closed position, said jaws being so disposed and dimensioned as to be capable of grasping an edge of a hide when in said closed position and releasing said edge when in said open position, each of said clamps being further provided with a brake operable between a locked condition, wherein said brake engages with the corresponding one of said guides so as to prevent motion of said clamp along said corresponding one only in said inward direction, and an unlocked condition, wherein said brake is disengaged so as to allow said clamp to travel in both said inward direction and said outward direction; and a hide changing table provided with a clamp displacement member for each of said clamps, said clamp displacement member being dimensioned and disposed so as to be capable of translating an individual one of said clamps along said corresponding one of said guides in both said inward direction and said outward direction under control of a detachment control and a stretching control;

the improvement comprising a mechanical linkage between said lever and said brake so configured as to place said brake in said locked condition when said pair of jaws are moved by said lever into said closed position and to place said brake in said unlocked condition when said jaws are moved into said open position;

a first jaw of said pair of jaws being fixed relative to each of said clamps, a second jaw of said pair being attached to said first jaw through a pair of pivoting linkages; and each said clamp displacement member is provided with a first gripping member which engages an inner edge of said individual one of said clamps to translate said individual one of said clamps in said outward direction, and a second gripping member which releasably engages an outer edge of said individual one of said clamps to impart a motion in said inward direction; said second gripping member being movably controlled relative to said clamp displacement member by said detachment control so as to be capable of engaging said outer edge only on command from said detachment control.

2. Apparatus according to claim 1, further including an additional pivot link connecting said lever with said second jaw.

3. Apparatus according to claim 1 further including a piston rod in a piston-and-cylinder means for engaging said second gripping means with said outer edge and simultaneously actuating said lever so as to move said jaws into said open position.

4. Apparatus according to claim 3 further including an edge sensor mounted on said clamp displacement member said edge sensor for sensing an edge of said hide and being so connected to said piston-and-cylinder means as to, upon sensing said edge activate said piston-and-cylinder means to disengage said second grippng member from said outer edge while at the same time releasing said lever, thereby closing said clamping jaws of said clamp.

5. Apparatus according to claim 1, further including a limit switch/valve attached to said first gripping member, said limit switch/valve being connected so as to control the engagement and disengagement of said second gripping member with said outer edge.

6. Apparatus according to claim 5, wherein further said stretching control is connected to the limit switch-/valve for operating the latter to cause disengagement of said second gripping member from said outer edge.

7. Apparatus according to claim 4, wherein further said edge sensor is a mechanical contact sensor movably mounted on said clamp displacement means so as to move between a first and second position wherein respectively said edge sensor may and may not contact said hide and wherein said piston-and-cylinder means operating said second gripping member is connected to move said edge sensor to said first position when said second gripping member is engaged with said outer edge and to said second position when said second position when said second gripping member is disengaged.

8. Apparatus according to claim 1 wherein further said stretching frame has outwardly curved sides to which said first ends of said guides have been affixed, said sliding guides are a pair of steel wires on above the other, and said pairs of steel wires are spaced side by side sufficiently close that they alone constitute a supporting base for the hide.

9. Apparatus according to claim 1, wherein further said brake is a turnably carried lever acted upon by a spring and by an opposed pusher pin.

* * * * *